US005510020A

United States Patent [19]

Gronlund

[11] Patent Number: 5,510,020

[45] Date of Patent: Apr. 23, 1996

[54] SWIMMING POOL SKIMMER

[76] Inventor: Robert Gronlund, 2730 Auburn Ave., Port Charlotte, Fla. 33948

[21] Appl. No.: 311,114

[22] Filed: Sep. 23, 1994

[51] Int. Cl.[6] ..... E04H 4/16

[52] U.S. Cl. ..... 210/169; 210/232; 210/249; 4/496

[58] Field of Search ..... 210/169, 249, 210/232, 409, 456, 499; 4/496

[56] References Cited

U.S. PATENT DOCUMENTS

| | | | |
|---|---|---|---|
| 3,244,284 | 4/1966 | Shaffer | 210/169 |
| 3,774,767 | 11/1973 | Field | 210/169 |
| 4,068,327 | 1/1978 | Heinlein | 210/169 |
| 4,225,436 | 9/1980 | Cseh | 210/169 |
| 4,369,109 | 1/1983 | Edge | 210/169 |
| 4,720,340 | 1/1988 | O'Brien | 210/169 |
| 4,734,189 | 3/1988 | Page, Jr. | 210/169 |
| 4,879,028 | 11/1989 | Gibson | 210/169 |
| 4,960,514 | 10/1990 | Paskert | 210/169 |

*Primary Examiner*—Stanley S. Silverman
*Assistant Examiner*—Theodore M. Green
*Attorney, Agent, or Firm*—Frank A. Lukasik

[57] ABSTRACT

A swimming pool skimmer apparatus having a skimmer arm with one end positioned inside the opening of a swimming pool weir and held in position by a pair of spring loaded pins, and the opposite end is shaped in the form of a hook to direct some of the water current flow along the line of the skimmer arm and toward the swimming pool weir. A screen is held in an opening formed within the skimmer arm along the greater part of the length and width of the skimmer arm. With the flow of the swimming pool inlets directed in one direction, a circular, counter clockwise current is set up and the pool skimmer of the invention diverts the debris into the swimming pool weir.

3 Claims, 7 Drawing Sheets

SWIMMING POOL SKIMMER

BACKGROUND OF THE INVENTION

1. Field of the Invention

This invention pertains generally to the field of pool skimming and more particularly, to a swimming pool skimmer which is snapped into the pool's skimmer opening which leads to the skimmer basket.

2. Description of the Prior Art

A conventional swimming pool installation usually incorporates a pump and filter located adjacent the pool for circulating and filtering the pool water. In these arrangements, one or more skimmers are usually provided which are adapted to skim off the upper surface of the pool water and pass it to the pump-filter assembly for filtering and recirculation. The amount of pool water skimmed is usually controlled by a floating weir associated with each skimmer which is responsive to the level of water in the pool to insure that only a predetermined amount of water from the upper surface of the swimming pool will be introduced into the skimmer.

There are numerous devices available for skimming water surfaces. The automatic skimming provided by a pool's circulation system through the surface drain is very slow and may take hours to process, to the best of its ability, the surface water that does pass through it. In addition, this type of skimming has been found to be ineffective against the lighter, more buoyant, detridus commonly floating in the surface of swimming pools, whether screened, unscreened, or indoor, (e.g., gnats, mites, spiders, dust pollen, hair, pollution fallout, etc.).

Hand held skimming devices which usually involve some form of screening mounted on a hoop attachable to a pole are also inefficient against the smaller but omnipresent types of debris outlined above. It is the inability of all known swimming pool skimming devices to cope with this fine debris and surface scum in an efficient and effective manner that a need was manifest for an apparatus that improved upon all known existing devices and methods in an expedient, effective and inexpensive manner.

Several prior art devices have been devised to provide some form of pool skimming. U.S. Pat. No. 3,932,281 to Pansini discloses a leaf trap kit for swimming pools which includes an inverted, perforate basket which is fitted over the main drain outlet of the pool, a dome like housing open at its underside to admit leaves into the space between the housing and the inverted basket and leaving a top opening through which such leaves may be removed, and a vacuum cleaner head fittable over the housing to remove the leaves from the top opening of the housing.

U.S. Pat. No. 4,348,281 to Perry et al discloses a skimmer assembly for swimming pools having a floating weir disposed in the housing for regulating the amount of water entering the housing from the skimming inlet and a filter basket is disposed in the housing with its open end communicating with the skimming inlet and a wall portion communicating with the drain inlet. An adapter member and a cover plate cooperate with the basic for selectively controlling the flow of water from the skimming inlet to the outlet.

U.S. Pat. No. 4,743,368 to Gates discloses a swimming pool skimming and vacuuming system including a passage plate for insertion in the passage interconnecting a pool filter to a pool. The passage plate has a skimmer weir positioned therein for drawing off scum from the upper surface of the pool. An aperture is formed in the plate for enabling automatic vacuuming of the pool while simultaneously enabling skimmer weir action to occur. A top mounting plate is secured in the skimmer well and contains a basket opening for enabling the top surface of the basket to be positioned in the plate. A regulator valve is connected to the pool suction pump for enabling the suction between the vacuum hose and the weir basket to be adjustably controlled.

U.S. Pat. No. 5,051,175 to Walczak et al discloses a drain guard and drain protection system. The system includes a surface layer having a ballast spread therealong, a drain opening extending through the surface layer, and a portion of the surface layer cleared of ballast, the portion outwardly extending from the drain opening to a drain guard.

Each of the above prior art devices rely on the pull of the pump suction to collect debris from the pool surface. Without some form of diversion, much of the debris circulates continuously around the pool, thus requiring expensive devices for collecting and discarding the many forms of debris which are caught by the pool surface. It is especially noticeable after a lawn is mowed since much of the dust and small particles of clippings inevitably settle on the pool surface. In southwest Florida, most of the pools are enclosed with a screen cage, which help to reduce floating debris, however, after each mowing, there is a surprising amount of dust, grass and insects which somehow make their way through the screens. Of course, if a swimming pool is not covered, the debris problem is worse.

SUMMARY OF THE INVENTION

It is therefore an object of the present invention to provide a a new and improved swimming pool skimming system which is inexpensive to manufacture, easy to assemble, easy to operate, and accomplishes its objectives in a speedy, efficient and effective manner.

It is another object of the invention to provide a swimming pool skimmer which directs flow from the pool surface into a pool skimmer opening (weir) for removal of floating debris.

It is a further object of the invention to provide a swimming pool skimmer having a skimmer arm held at an angle to the pool wall to guide flowing debris into the pool skimmer opening.

Toward the fulfillment of these and other objects, the skimming apparatus of the present invention comprises a skimmer arm which is snapped into the swimming pool weir opening which leads to the skimmer basket. The invention comprises a narrow length of wood or plastic material with a spring loaded mounting end which is inserted into the pool's weir opening and the skimmer arm is held at an angle to the circular flow of the surface of the water. The inlet jets of the pool are all turned to circulate the surface water toward the skimmer. There is an opening in the center of the skimmer arm, filled with screening to permit some water flow while guiding the debris toward the skimmer opening. The outward end is hook shaped in a manner to direct debris toward the swimming pool weir opening.

DESCRIPTION OF THE PREFERRED EMBODIMENT

Figure 1:
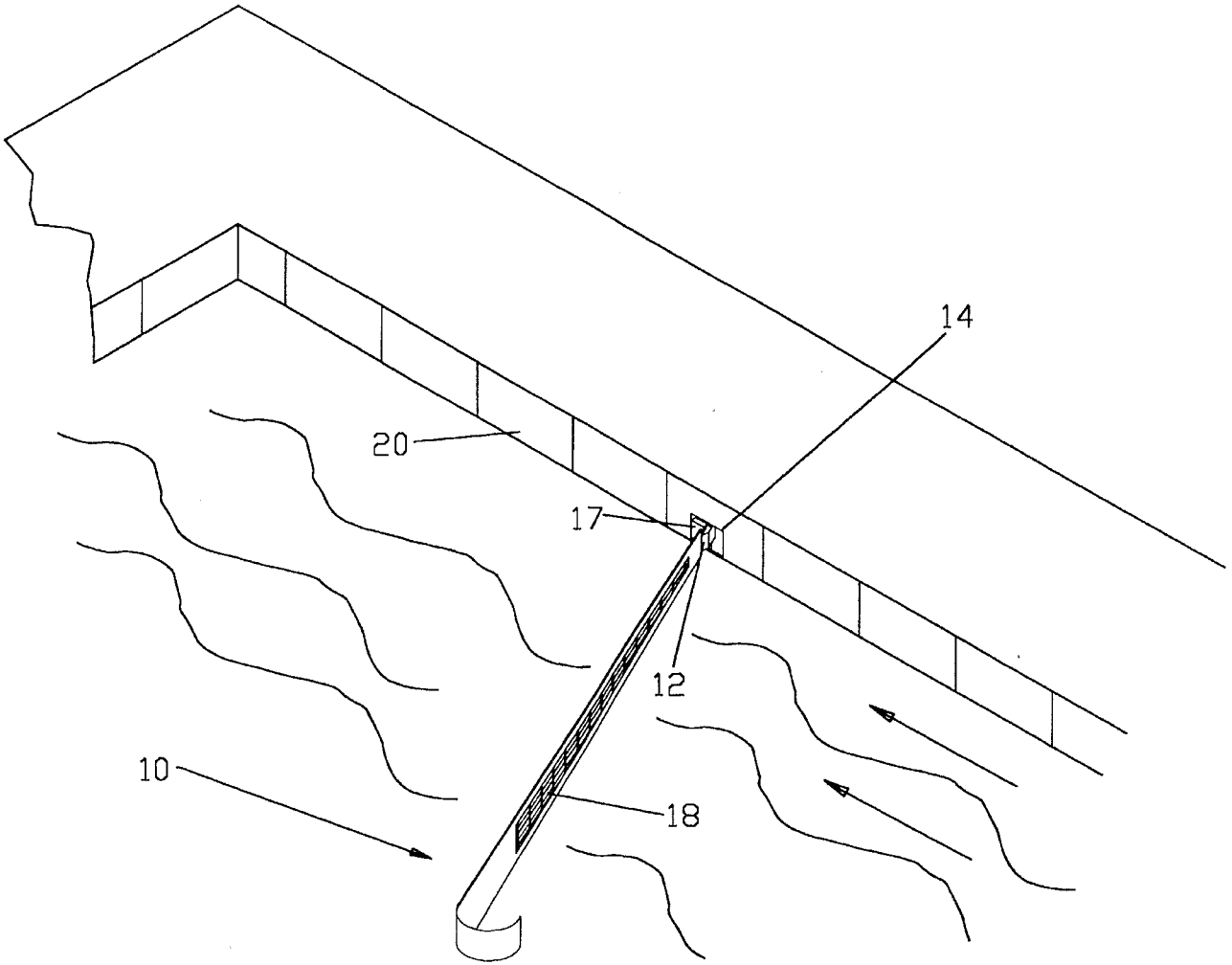
FIG. 1 is a top perspective view of the pool skimmer of the invention installed in a pool weir opening.
Figure 2:
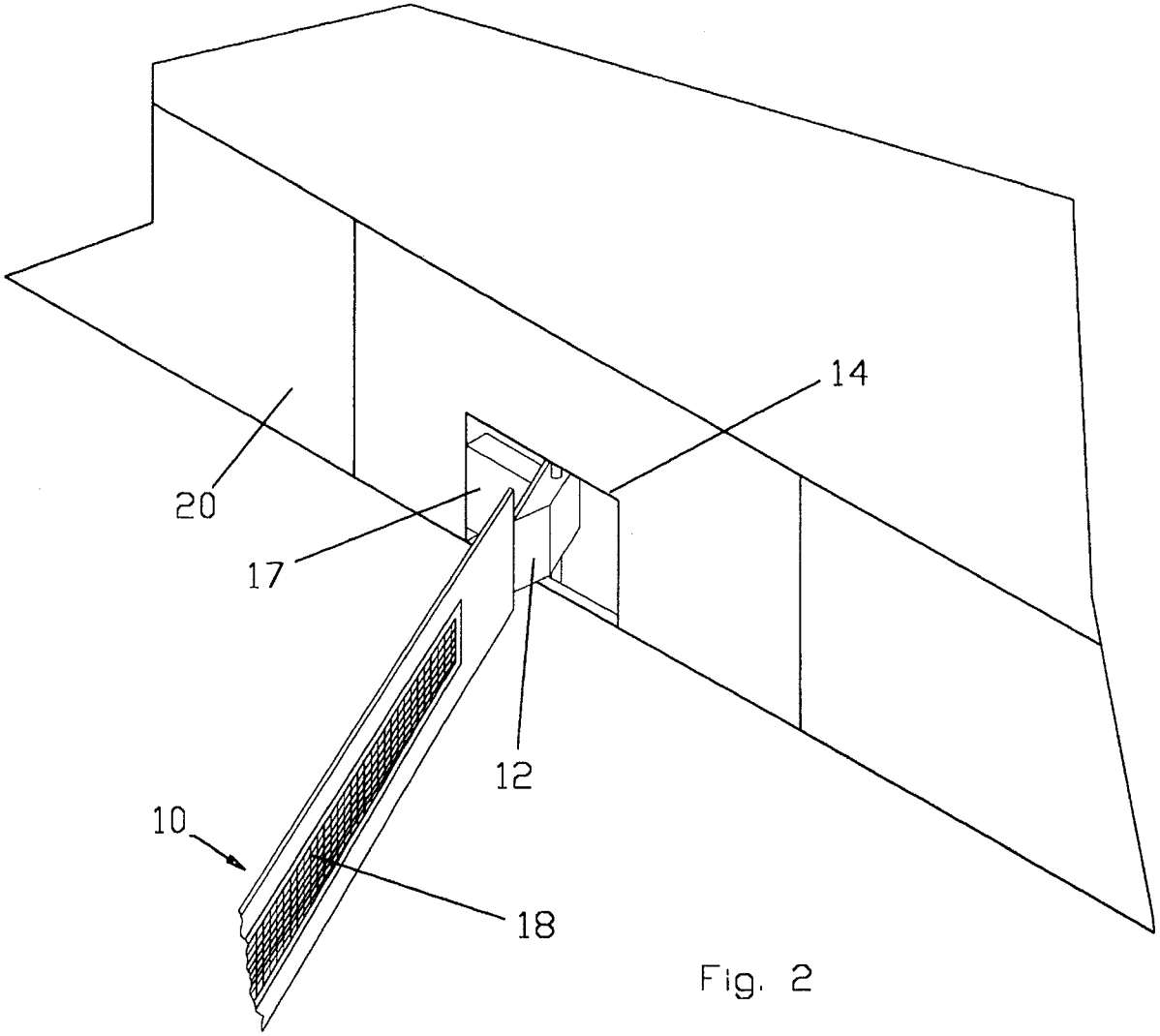
FIG. 2 is an expanded view, partly in section, of the pool skimmer of the invention installed in a pool weir opening.
Figure 3:
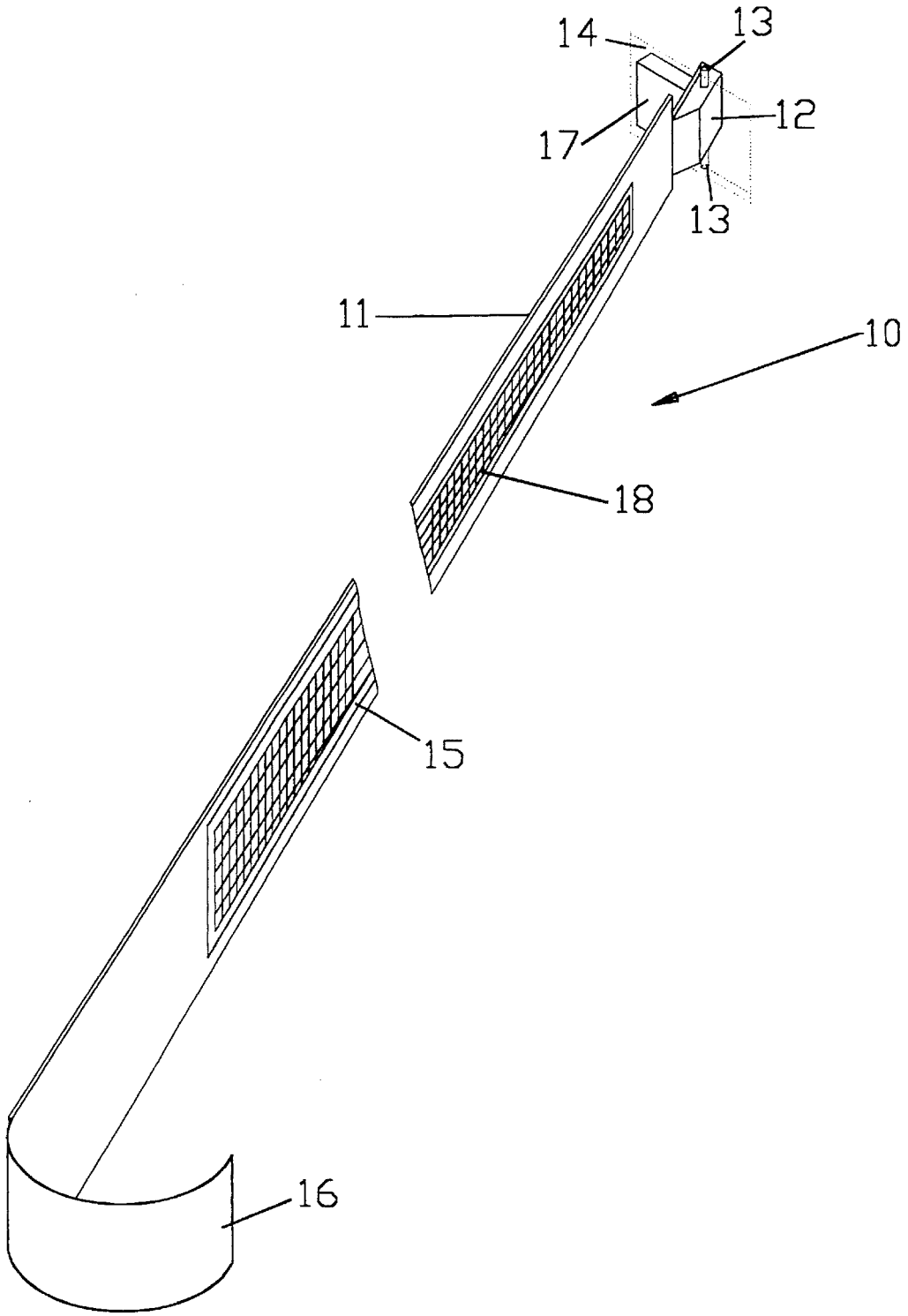
FIG. 3 is is a top perspective view, partly in section, of a pool skimmer of the invention.

The present invention is directed toward the removal of all surface debris from the water surface of swimming pools in general. Referring now to FIG. 1 of the drawings, there is shown a swimming pool skimmer assembly designated by the numeral 10, positioned inside the opening of the swimming pool weir 14, and used in the swimming pool 20 skimming and vacuuming cleaning system. In normal operation, the system of FIG. 1 utilizes skimmer 10 to direct the flow of floating debris into the swimming pool weir 14. As shown in FIGS. 1 through 8, the apparatus consists of a narrow length of wood, or plastic, skimmer arm 11, with a spring loaded mounting end 12, which is positioned within the pool skimming weir. There is an opening 15 formed within the skimmer arm 11, along the greater part of the length and width of skimmer arm 11, between the mounting end 12 and the hooked end 16 to permit water flow to continue circulating around the periphery of the swimming pool 20. A plastic, fiberglass, or stainless steel screen 18 is positioned in the opening 15 and is of a sufficiently fine mesh to screen out the debris but also to permit water to flow therethrough. The filtered debris will then be drawn into the swimming pool weir 14 and eventually through the swimming pool 20 filter.

Skimmer arm 11 has a hooked end 16 formed on the end opposite the mounting end 12. Hooked end 16 may be formed in plastic when skimmer arm 11 is molded from plastic or it may be made from some other material and be attached to the skimmer arm 11 if the skimmer arm 11 is made from some other material. The hooked end 16 acts to direct some of the current flow along the line of skimmer arm 11 and toward the swimming pool weir 14. As the flow passes the front side of screen 18, the debris which has been filtered out by screen 18 is carried by the swimming pool water flow.

Figure 4:
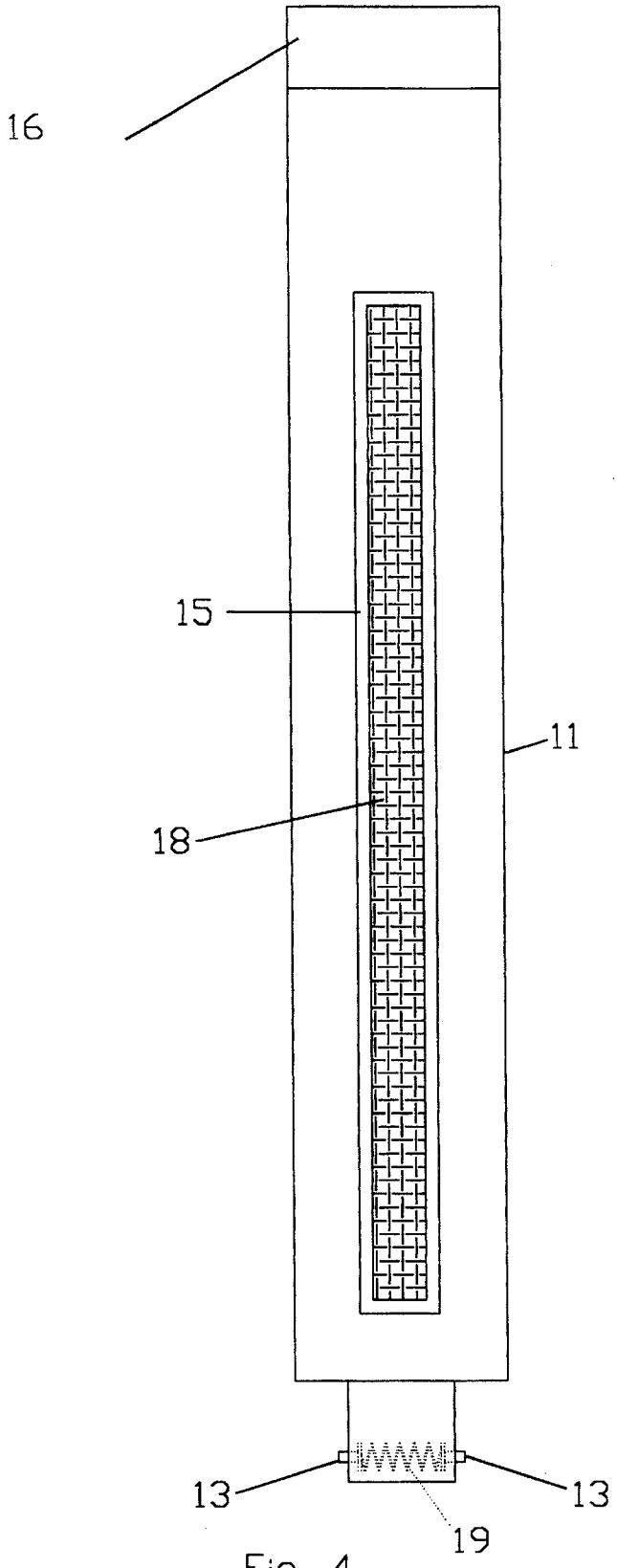
FIG. 4 is a front view of a pool skimmer in accordance with the invention.
Figure 5:
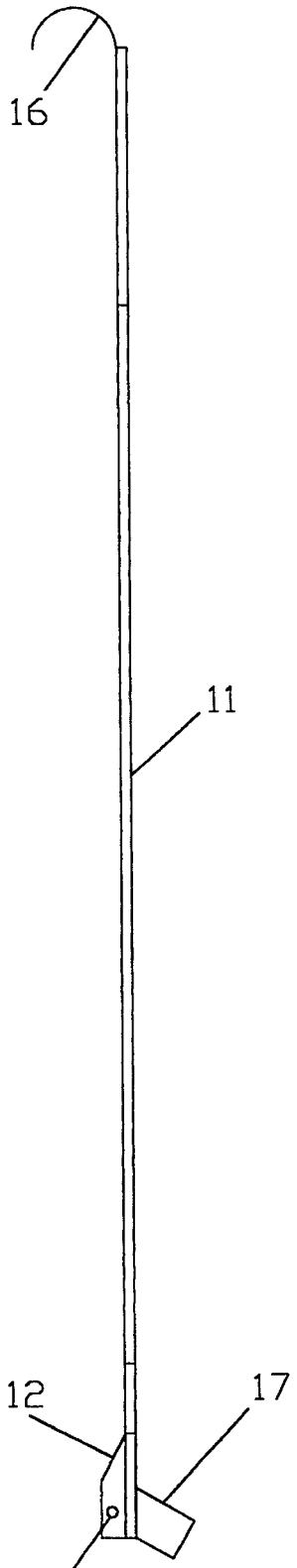
FIG. 5 is a top view of a pool skimmer in accordance with the invention.
Figure 6:
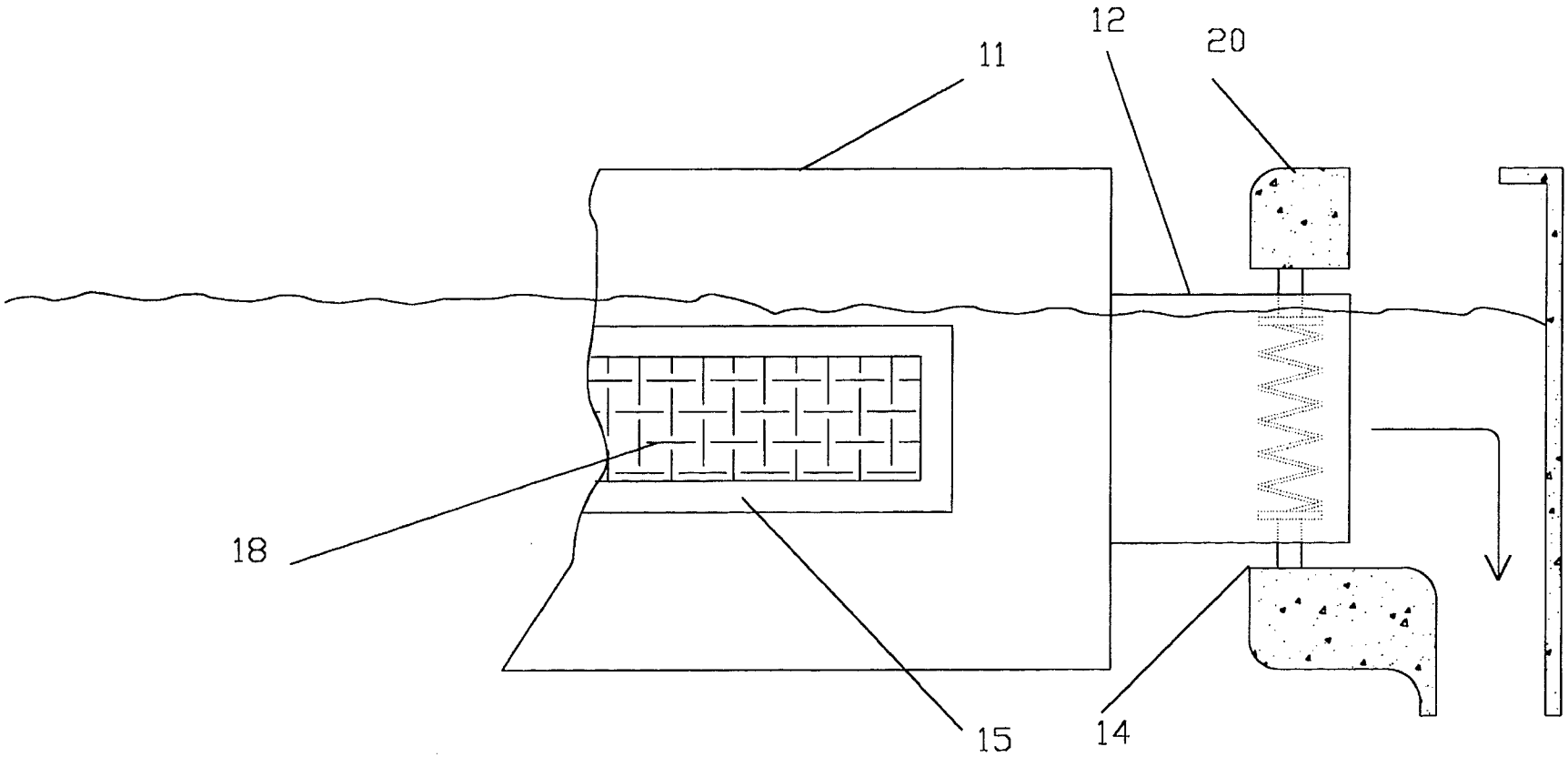
FIG. 6 is an expanded front view, partly in section, of the pool skimmer of the invention installed in a pool weir opening.
Figure 7:
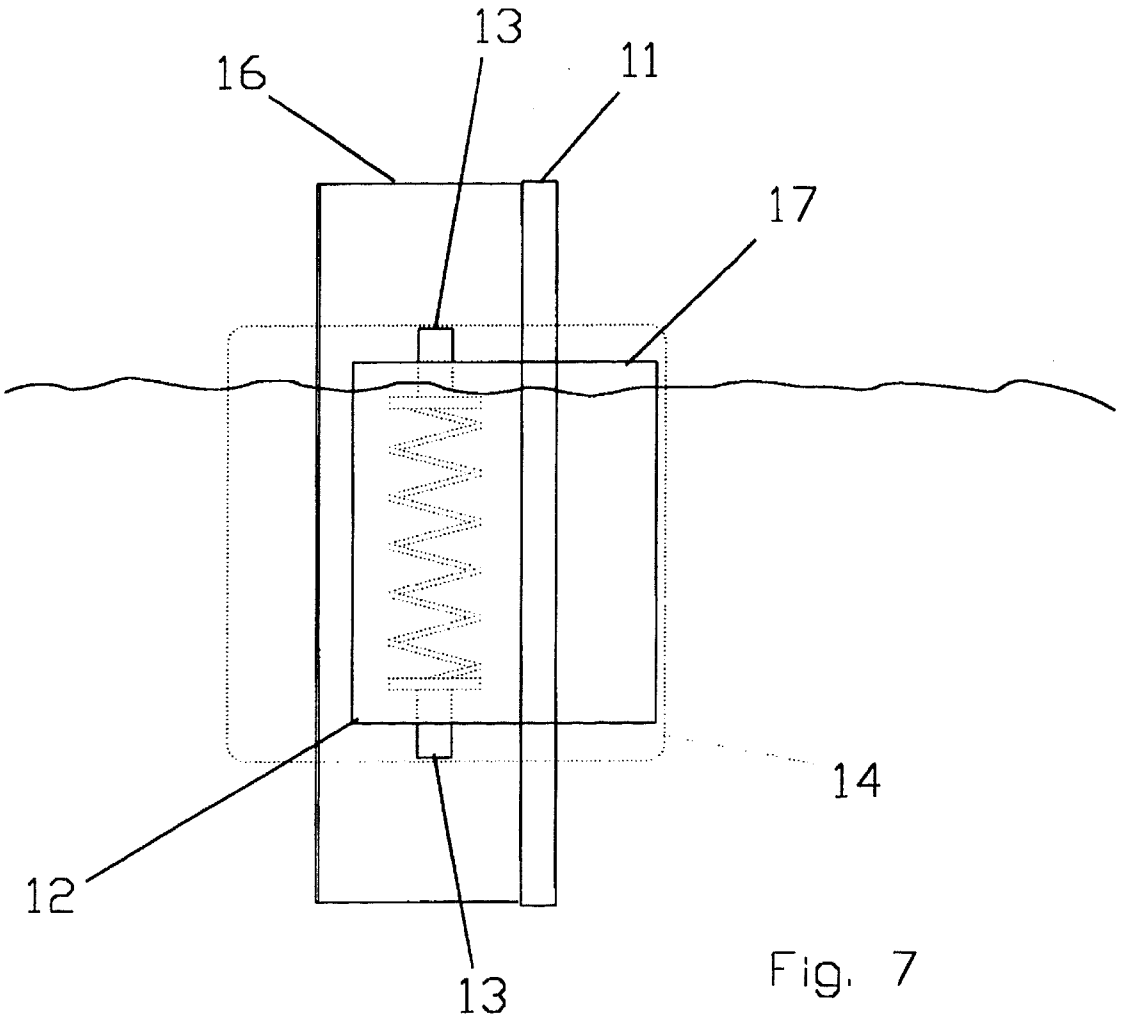
FIG. 7 is an end view, from inside the pool weir, of the pool skimmer in accordance with the invention.
Figure 8:
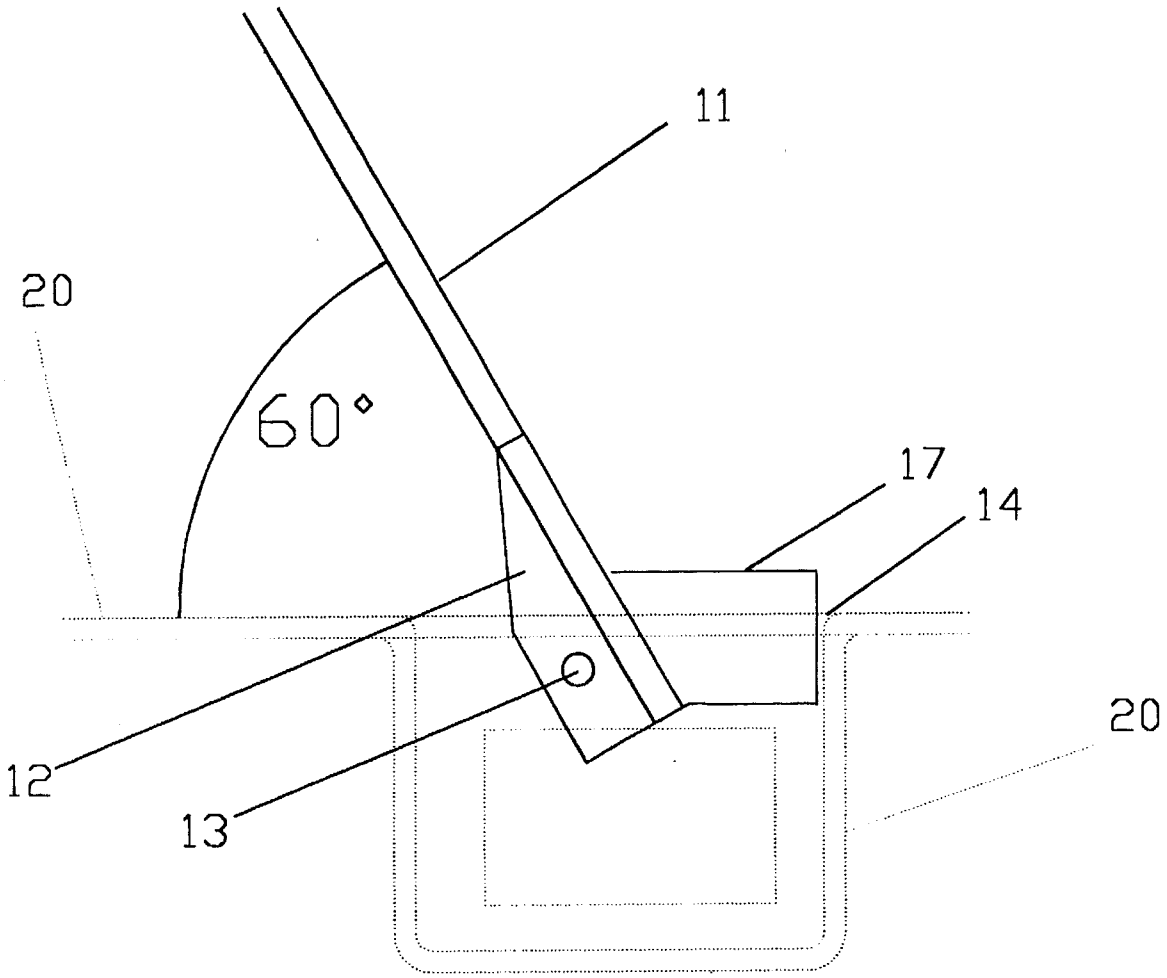
FIG. 8 is a top view, partly in section, of the mounting end of the pool skimmer in accordance with the invention.

Referring to FIGS. 4 through 6, the details of construction of mounting end 12 are shown. Pins 13 and spring 19 are assembled in mounting end 12 in a manner well known in the art and are used to lock mounting end 12 in the swimming pool weir 14 by exerting holding pressure on the top and bottom surfaces of weir 14. Block 17, attached to mounting end 12, or formed simultaneously with mounting end 12 when molded of plastic, is placed against a side wall of swimming pool weir 14 and is shaped at an angle of 60° to hold swimming pool skimmer 10 at 60° to the side of pool 20 and the water current flow. In a preferred embodiment, skimmer arm 11 is four feet long and six inches high.

THEORY OF OPERATION

In practice, the swimming pool skimmer 10 is positioned within swimming pool weir 14 and set at 60° to the side of pool 20 and the flow of water in the pool 20. A circular flow in the pool 20 is started by turning the water inlet jets (not shown) to the right when standing and facing the pool. With the water inlet jets facing in the same direction, a continuous, counter clockwise current circulates and carries the detridus toward the extended skimmer 10 where it is diverted and directed into the swimming pool weir 14. The water and detridus is pulled into the swimming filter and the water is recirculated. It has been found that on the average, the swimming pool surface may be completely skimmed within 15 to 30 minutes using the swimming pool skimmer 10 of the invention.

While the invention has been explained with respect to a preferred embodiment thereof, it is contemplated that various changes may be made in the invention without departing from the spirit and scope thereof.

What is claimed is:

1. A swimming pool water skimming apparatus for directing large objects as well as all debris and scum from the water surface of a swimming pool filled with water, said water circulating in a counter-clockwise direction and said pool having a water skimming weir therein, said weir having top and bottom surfaces and a first and a second sidewall, said apparatus comprising:

a skimmer arm having a mounting end, an opposite end, and an opening along the length and width of said skimmer arm between said mounting end and said opposite end, a pair of spring loaded pins assembled in said mounting end for locking said mounting end between the top and bottom surfaces of said swimming pool weir opening, a shaped block affixed to said mounting end and placed against said first sidewall of said weir for holding said skimmer arm at a 60° angle horizontal to the swimming pool weir opening and horizontal to said water surface, and a screen fitted within said skimmer arm opening to permit some water flow to continue circulating for filtering debris from the pool water flow and directing the debris into the swimming pool weir opening, and hooked end means affixed to said opposite end for directing some of the current flow along said skimmer arm toward the swimming pool weir, thereby carrying debris and scum away from said screen and into said weir.

2. A skimming apparatus as set forth in claim 1 wherein said skimmer arm, said hooked end, and said shaped block are molded plastic.

3. A skimming apparatus as set forth in claim 1 wherein said skimmer arm is made of wood and said shaped block and said hooked end are affixed to said skimmer arm.

* * * * *